US012064043B2

(12) United States Patent
Lin

(10) Patent No.: US 12,064,043 B2
(45) Date of Patent: Aug. 20, 2024

(54) STRAW CUP

(71) Applicant: Tsai-Hui Lin, Kaohsiung (TW)

(72) Inventor: Tsai-Hui Lin, Kaohsiung (TW)

( * ) Notice: Subject to any disclaimer, the term of this patent is extended or adjusted under 35 U.S.C. 154(b) by 82 days.

(21) Appl. No.: 18/058,779

(22) Filed: Nov. 25, 2022

(65) Prior Publication Data

US 2024/0172883 A1 May 30, 2024

(51) Int. Cl.
*A47G 19/22* (2006.01)
*B65D 1/40* (2006.01)

(52) U.S. Cl.
CPC ..... *A47G 19/2272* (2013.01); *A47G 19/2288* (2013.01); *B65D 1/40* (2013.01)

(58) Field of Classification Search
CPC ..... B65D 51/242; B65D 51/24; B65D 1/40; A47G 19/2272; A47G 21/189; A47G 21/18
USPC ..... 220/212.5, 212, 709, 707, 705, 62.18, 220/62.12, 62.11; 215/229, 388
See application file for complete search history.

(56) References Cited

U.S. PATENT DOCUMENTS 2,052,496 A * 8/1936 Stassi ..... A47G 21/18 215/229
3,172,561 A * 3/1965 Schwartz ..... A61J 9/00 215/11.1
4,448,316 A * 5/1984 Hiroshige ..... B65D 77/283 215/229
4,684,032 A * 8/1987 Tsay ..... A47J 41/0027 222/530
5,282,541 A * 2/1994 Chen ..... A47G 19/2266 220/254.1
5,337,918 A * 8/1994 Wang ..... A47G 19/2266 222/536
6,523,711 B1 * 2/2003 Hughes ..... B05B 11/1097 239/33
2005/0040175 A1 * 2/2005 Stephens ..... B65D 47/061 220/709
2011/0226133 A1 * 9/2011 Shen ..... A47J 31/005 99/316
2021/0015280 A1 * 1/2021 Kalisz ..... B65D 47/065

FOREIGN PATENT DOCUMENTS

CN 111195051 A * 5/2020 ..... A47G 21/18
CN 114568903 A * 6/2022 ..... A47G 19/22
GB 2367056 A * 3/2002 ..... A47G 19/2266
WO WO-9846106 A1 * 10/1998 ..... A47G 19/2266

* cited by examiner

*Primary Examiner* — Robert J Hicks
(74) *Attorney, Agent, or Firm* — Rosenberg, Klein & Lee

(57) ABSTRACT

A straw cup is provided. The straw cup includes a cup and an upper lid which is mounted with a straw base therein and connected with a straw. A non-return pad used to prevent leakage is arranged at the straw base which is covered and fastened with an outer cover, and the outer cover is provided with a loop handle for carrying. Thereby users can drink beverages by the straw on the upper lid and the straw is protected from contamination by the upper lid. Moreover, the beverage will not leak out when the straw cup is tipped over and users can carry the straw cup easily.

4 Claims, 5 Drawing Sheets

STRAW CUP

BACKGROUND OF THE INVENTION

Field of the Invention

The present invention relates to a straw cup, especially to a straw cup built with a straw therein.

Description of Related Art

Generally, while drinking various types of beverages, disposable straws are often used to insert through a preset hole on a lid of a cup or pierce a sealing film on the cup to get access to beverages in the cup. Once the beverage the user has not finished is left in the cup, the straw is also left in the cup (container) with the beverage. The exposed straw attached with the beverage is easy to get dirt, stains, or even mosquitoes and insects. Thus the straw is contaminated and as a result there is a hygiene problem. Moreover, the disposable straws are made of ungradable plastic material so that a large amount of the plastic straws after use lead to serious environmental pollutions.

Thus a straw cup has been developed. The straw cup available on the market now mainly includes a cup, a lid and a straw. The cup is covered by the lid which is provided with a flip cap. One end of the straw is inserted into the cup while the other end protrudes from the lid. A part of the straw out of the lid is pressed and folded to be held in the flip cap. When a user stops drinking a liquid in the cup, the protruding part of the straw is folded and held in the flip cap for preventing the liquid in the cup from flowing out through the straw. However, the flip cap is often opened by accidental touch so that the liquid in the cup comes out through the straw and leaks outside. The straw cup is inconvenient to use.

Thus there is room for improvement and there is a need to provide a straw cup which is more convenient to use.

SUMMARY OF THE INVENTION

Therefore, it is a primary object of the present invention to provide a straw cup which features on easy carrying, no leakage, and protection of straws from contamination.

In order to achieve the above object, a straw cup according to the present invention mainly includes a cup and an upper lid which is mounted with a straw base therein and connected with a straw. A non-return pad for leakage prevention is arranged at the straw base which is connected to and covered by an outer cover. A loop handle for carrying is disposed on the outer cover. Thereby users can drink beverages by the straw on the upper lid and the straw is protected from contamination by the upper lid. Moreover, the straw cup provides multiple functions including no leakage of beverages when the straw cup is tipped over, easy carrying, etc.

Preferably, the cup is composed of an outer cup and an inner cup mounted inside the outer cup.

Preferably, the inner cup is provided with an inner connection portion disposed on an opening of the inner cup while an outer connection portion corresponding to the inner connection portion is arranged at the upper lid for being connected to and positioned by the inner connection portion.

Preferably, a tightly-sealed washer is disposed between the cup and the upper lid.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

In order to learn technical content, purposes and functions of the present invention more clearly and completely, please refer to the following detailed descriptions with the figures and reference signs.

Figure 1:
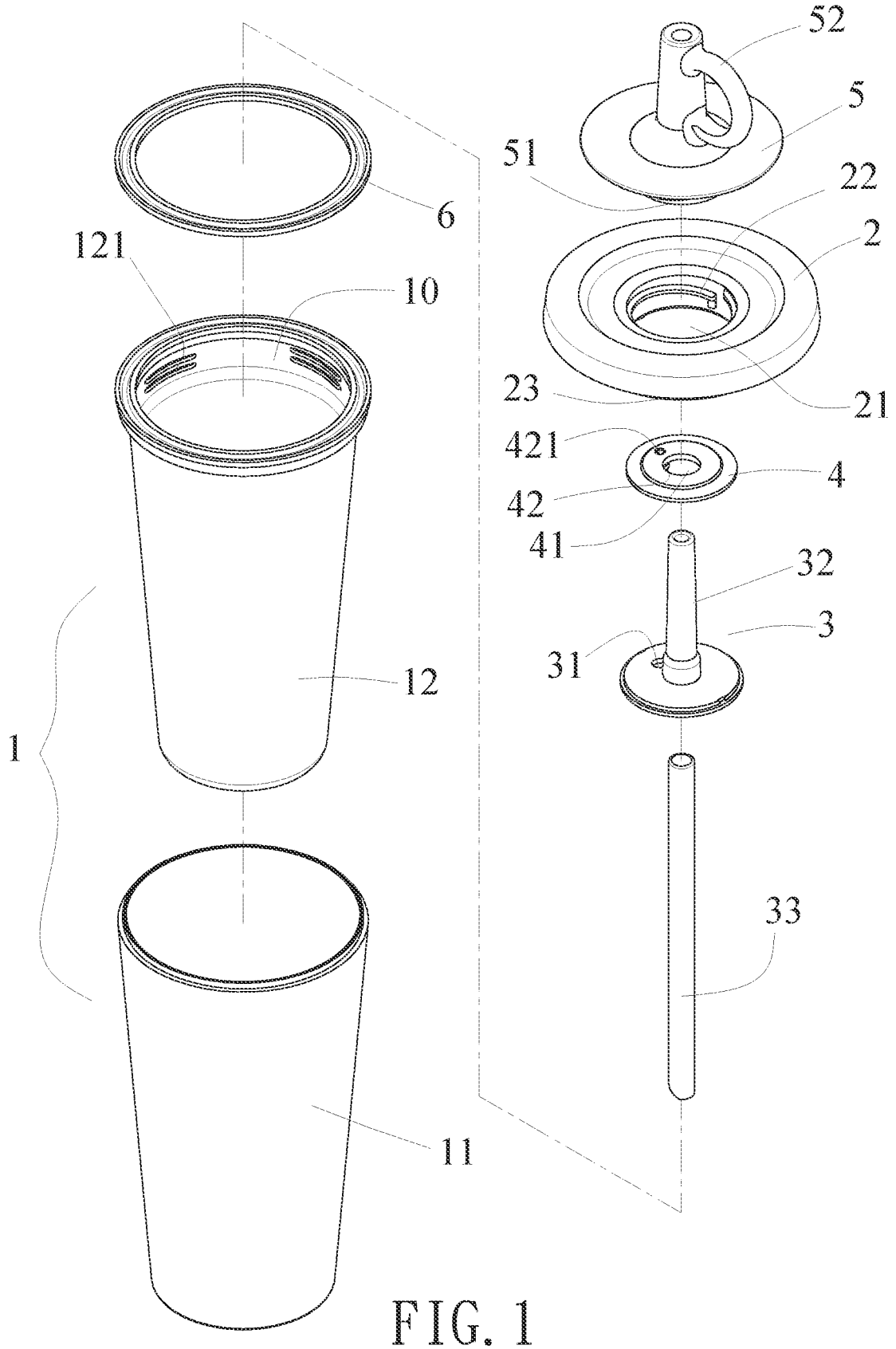
FIG. 1 is an exploded view of an embodiment according to the present invention.
Figure 2:
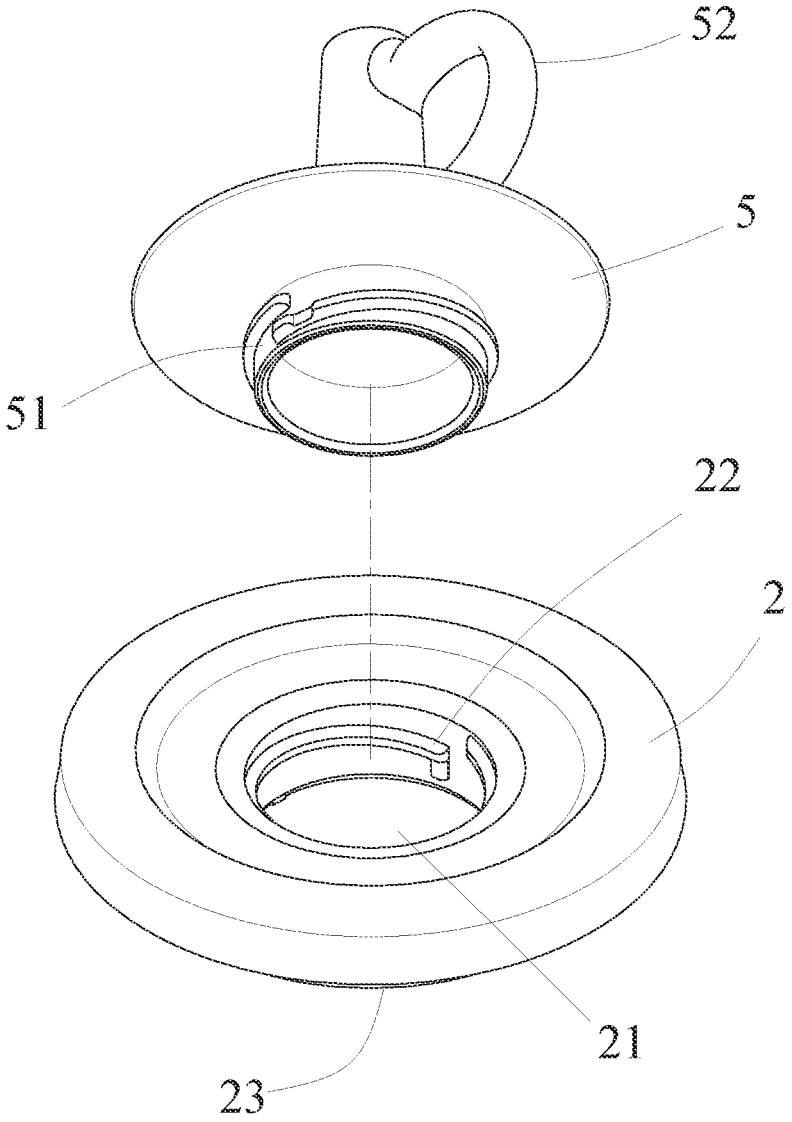
FIG. 2 is a partial exploded view of an embodiment according to the present invention.
Figure 3:
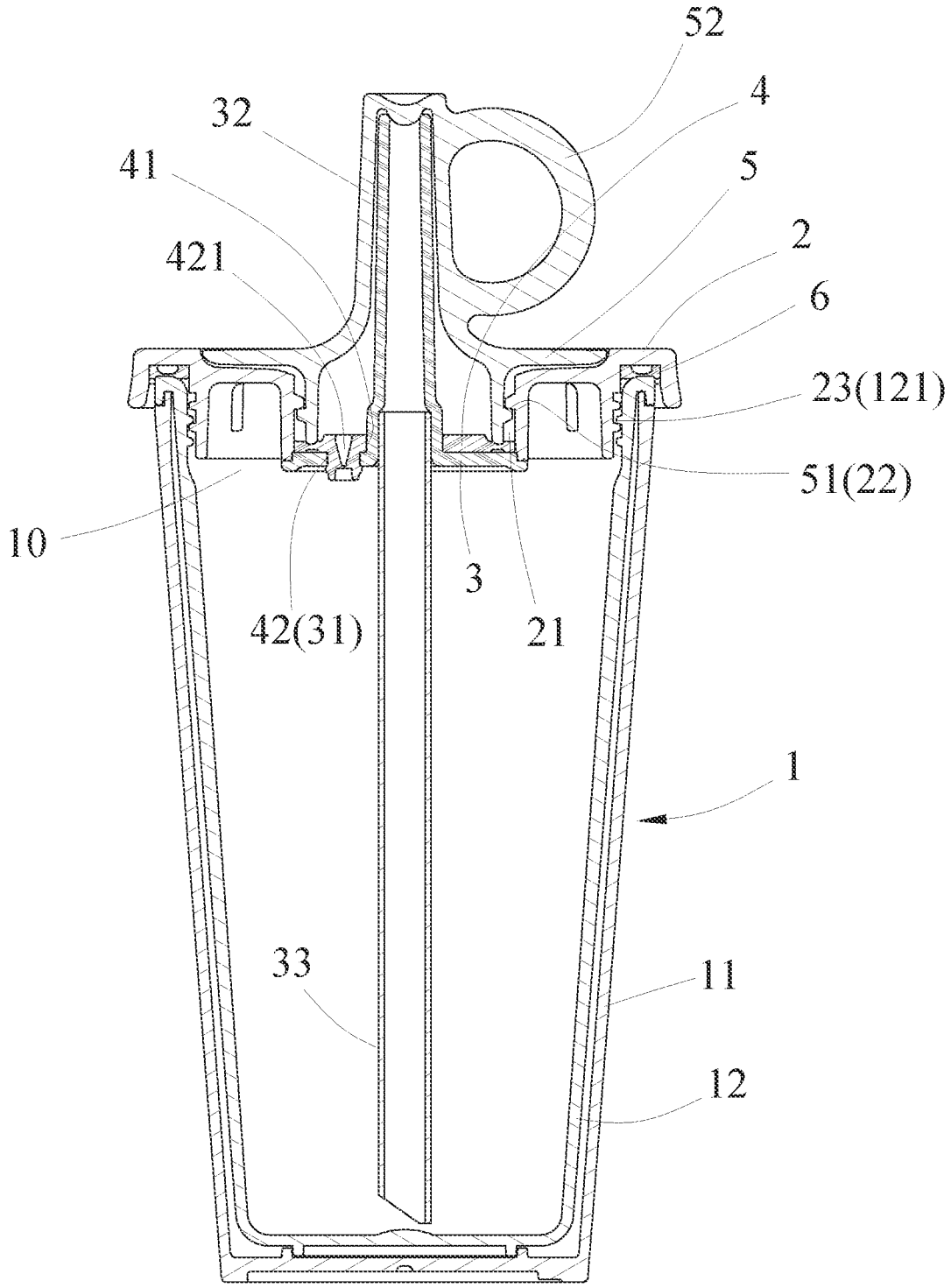
FIG. 3 is a sectional view of an embodiment in a covered state according to the present invention.
Figure 4:
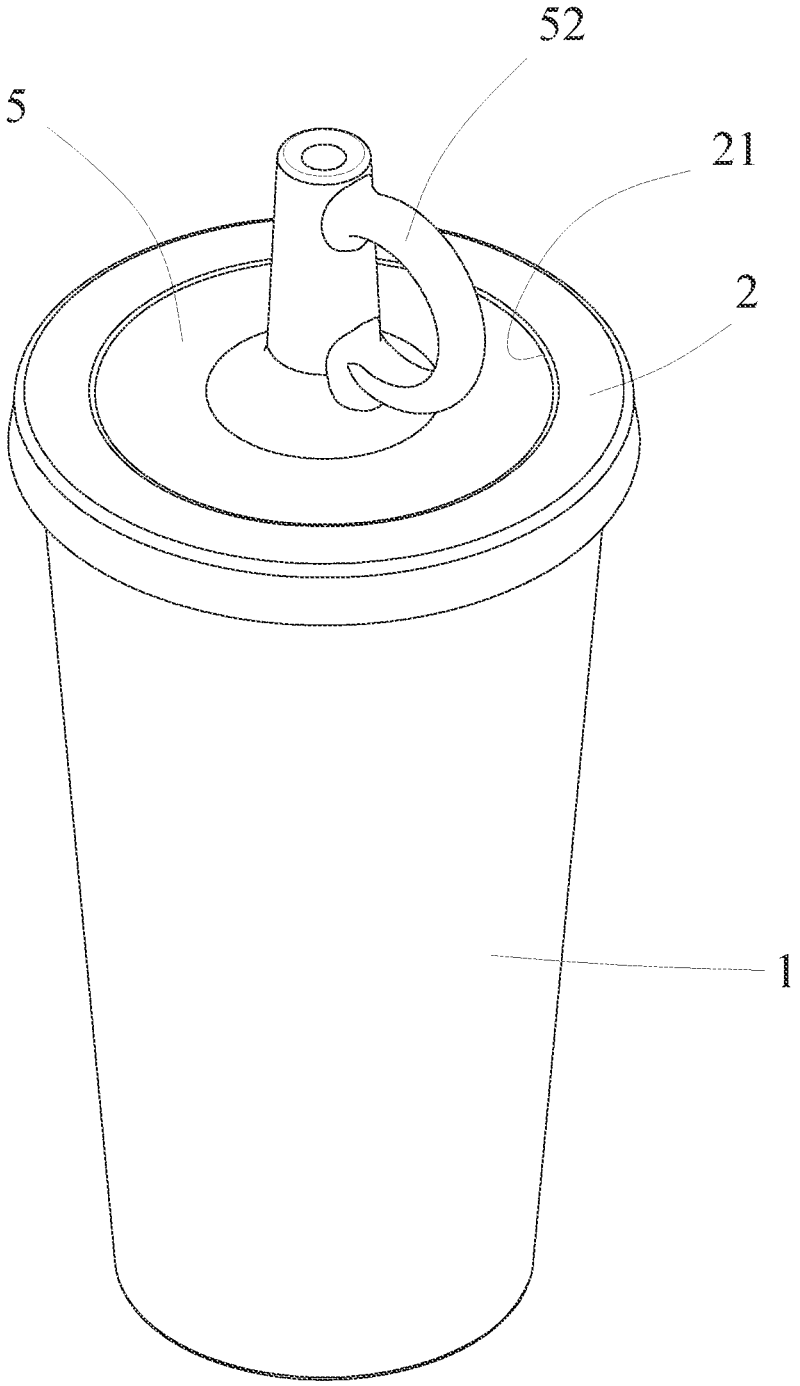
FIG. 4 is a perspective view of an embodiment according to the present invention.
Figure 5:
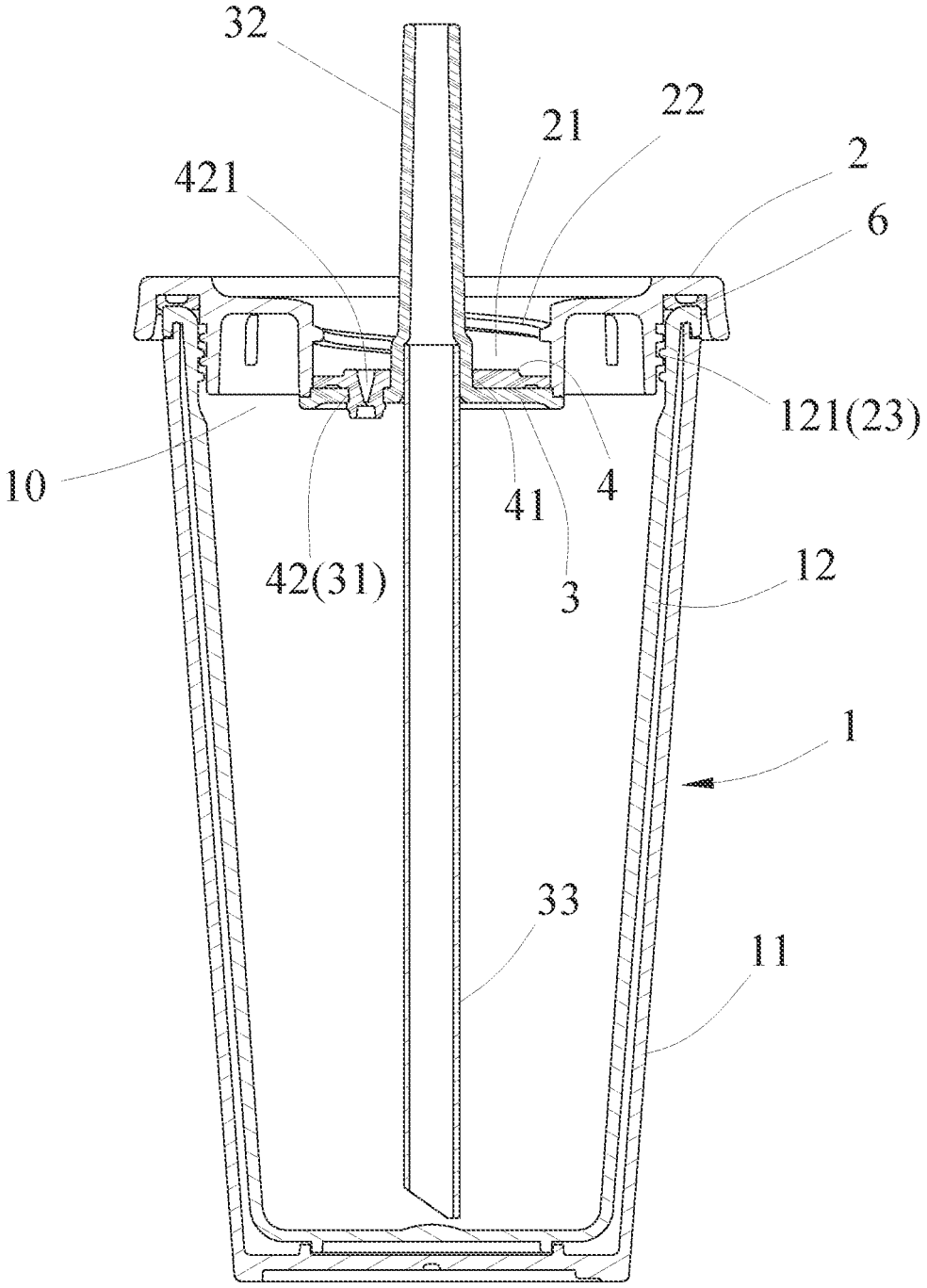
FIG. 5 is a sectional view of an embodiment showing an outer cover in an open state according to the present invention.

Refer to FIG. 1 and FIG. 2, a straw cup according to the present invention mainly includes a cup 1, an upper lid 2, a straw base 3, a non-return pad 4, and an outer cover 5.

The cup 1 is provided with an open end 10.

The upper lid 2 which consists of a through hole 21 and an inner threaded portion 22 formed on an inner surface of the through hole 21 covers the open end 10 of the cup 1 tightly.

The straw base 3 is inserted through and arranged at the through hole 21 of the upper lid 2 and provided with a hole 31, a mouthpiece 32 extending from a center thereof, and a straw 33 mounted to a bottom of the mouthpiece 32.

The non-return pad 4 is provided with an insertion hole 41 which allows the mouthpiece 32 of the straw base 3 to insert through and a plug 42 which is capable of being mounted into the hole 31 and provided with a micro-hole 421 communicating with an inner space of the cup 1.

The outer cover 5 is placed outside the straw base 3 for covering the straw base 3. The outer cover 5 includes an outer threaded portion 51 and a loop handle 52 while the outer threaded portion 51 is used for being engaged and fastened with the inner threaded portion 22 of the upper lid 2.

As shown in FIG. 1-5, the cup 1 of the straw cup according to the present invention can be different types such as a vacuum cup, an insulated cup, a double wall cup, etc. The cup 1 consists of an outer cup 11 and an inner cup 12 which is mounted inside the outer cup 11 and in provided with an inner connection portion 121 disposed on an opening of the inner cup 12. An outer connection portion 23 corresponding to the inner connection portion 121 is arranged at the upper lid 2 for being connected to and positioned by the inner connection portion 121. Moreover, a tightly-sealed washer 6 is disposed between the cup 1 and the upper lid 2.

It should be noted that the straw base 3 is inserted into and mounted in the through hole 21 of the upper lid 2. The straw base 3 is further connected with the upper lid 2 by welding technique. However, the processing technique mentioned above is only one of the embodiments. The straw base 3 can be connected with the upper lid 2 by other techniques.

After the cup 1 is filled with beverages, the upper lid 2 is fastened and fixed on the open end 10 of the cup 1 by the inner and the outer connection portions 121, 23 and the straw 33 enters the cup 1. Then the outer cover 5 is fastened and fixed on the upper lid 2 by the outer threaded portion 51 engaged with the inner threaded portion 22 and the mouthpiece 32 of the straw base 3 is completely enclosed in the outer cover 5. When the straw cup is tipped over by careless users, the beverage will not leak out due to design of the non-return pad 4 which prevents external air from entering the cup 1. Thus there is no change in pressure inside the cup 1 and no leakage occurs. At the same time, the mouthpiece 32 is completely covered by the outer cover 5 to avoid dirt and stains for hygiene purposes. The loop handle 52 of the outer cover 5 is for ease in carrying.

In order to drink the beverages, the outer cover 5 is rotated and unlocked so that the mouthpiece 32 is exposed. Thus the beverage inside the cup 1 is drawn through the mouthpiece 32. Since the micro-hole 421 of the plug 42 on the non-return pad 4 is communicated with the inner space of the cup 1, pressure inside the cup 1 is balanced through the micro-hole 421 when users suck the beverage. Thereby the user can drink the beverage inside the cup 1 smoothly through the mouthpiece 32.

Compared with techniques available now, the straw cup of the present invention has the following advantages:

1. A liquid in the cup will not leak out when the straw cup is tipped over due to the design of the non-return pad which prevents external air from entering the cup and further changes in the pressure inside the cup.
2. The straw cup is easy carrying and convenient to use because of the loop handle.
3. The mouthpiece is completely covered by the outer cover to avoid dirt and stains for hygiene purposes.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A straw cup comprising:

a cup provided with an open end;

an upper lid which is used for covering the open end of the cup tightly and provided with a through hole and an inner threaded portion formed on an inner surface of the through hole;

a straw base which is inserted through and arranged at the through hole of the upper lid and provided with a hole, a mouthpiece extending from a center thereof, and a straw mounted to a bottom of the mouthpiece;

a non-return pad having an insertion hole which allows the mouthpiece of the straw base to insert through, and a plug capable of being mounted into the hole and provided with a micro-hole communicated with an inner space of the cup; and an outer cover used for covering the straw base and provided with an outer threaded portion for being engaged and fastened with the inner threaded portion of the upper lid and a loop handle.

2. The straw cup as claimed in claim 1, wherein the cup includes an outer cup and an inner cup mounted inside the outer cup.

3. The straw cup as claimed in claim 2, wherein the inner cup is provided with an inner connection portion disposed on an opening of the inner cup while an outer connection portion corresponding to the inner connection portion is arranged at the upper lid for being connected to and positioned by the inner connection portion.

4. The straw cup as claimed in claim 3, wherein a tightly-sealed washer is disposed between the cup and the upper lid.

* * * * *